United States Patent [19]

Looker

[11] 4,016,911

[45] Apr. 12, 1977

[54] WOVEN ROPE

[75] Inventor: Robert Looker, Carpinteria, Calif.

[73] Assignee: Satron, Inc., El Segundo, Calif.

[22] Filed: Mar. 17, 1975

[21] Appl. No.: 558,911

[52] U.S. Cl. ..... 139/383 R; 139/415; 139/426 R; 28/72 R; 28/74 R; 428/257

[51] Int. Cl.[2] ..... D03D 1/00; D03D 3/00

[58] Field of Search ..... 139/383 R, 384 R, 426 R, 139/425 R, 124 R, 20, 408, 409, 415, 11, 440, 441, 442; 57/140, 144; 87/6.9; 428/257, 258, 259, 267, 395; 28/72 R, 72 PT, 74 R, 75 R

[56] References Cited

UNITED STATES PATENTS

| | | | |
|---|---|---|---|
| 841,154 | 1/1907 | Kast | 139/425 R |
| 926,868 | 7/1909 | Hammond | 139/425 R |
| 966,830 | 8/1910 | Hammond | 139/425 R |
| 1,964,656 | 6/1934 | Allwood et al. | 139/11 |
| 1,987,524 | 1/1935 | Byrem | 139/124 R |
| 2,398,484 | 4/1946 | Williamson | 139/415 |
| 2,587,877 | 3/1952 | Mossmer | 28/72 R |
| 2,652,072 | 9/1953 | Villa et al. | 139/124 R |
| 2,880,568 | 4/1959 | Starr | 28/74 R |
| 3,103,448 | 9/1963 | Ross | 28/75 R |
| 3,689,354 | 9/1972 | Mamok et al. | 428/267 |

FOREIGN PATENTS OR APPLICATIONS

| | | | |
|---|---|---|---|
| 313,074 | 10/1919 | Germany | 139/425 R |
| 580,826 | 7/1933 | Germany | 139/124 R |
| 833,387 | 4/1960 | United Kingdom | |
| 566,922 | 1/1945 | United Kingdom | 139/124 R |
| 22,420 | 1899 | United Kingdom | 139/408 |

*Primary Examiner*—James Kee Chi
*Attorney, Agent, or Firm*—George F. Smyth

[57] ABSTRACT

Woven rope includes a plurality of warp strands which extend longitudinally and cooperate with at least one weft strand which pulls the warp strands radially inwardly so that the resultant cordage has the appearance and feel of round rope, i.e. a cross-sectional thickness to width ratio of at least 0.75. The resulting woven cordage has greater strength than comparable braided or twisted rope. The woven rope may be made by weaving a plurality of strands with a weft strand which is under tension to pull the warp strands inwardly, or in the case of strand material which shrinks, e.g. nylon, the rope may be woven slightly loosely in a general oval shape and treated in boiling water to bring about shrinking of the assemblage of strands into a generally round shape. In one form, pre-woven or unwoven longitudal strands form the center of the woven rope. Typical materials which may be used to form rope are those presently used, e.g. nylon, polyolefins, hemp. etc.

29 Claims, 15 Drawing Figures

WOVEN ROPE

FIELD OF THE INVENTION

This invention relates to cordage and more particularly to an improved rope having the feel and handling of round rope but offering the advantage of greater strength per unit weight than a rope of the plaited or twisted type.

DESCRIPTION OF THE PRIOR ART

Rope type of cordage is known in which yarn strands are twisted or plaited together to provide a generally round rope of considerable strength. In the case of any twisted or plaited rope the total tensile strength of the rope is substantially less than the sum of the tensile strength of the strands making up the rope. By way of explanation, when twisted or plaited rope is pulled in tension, the fibers extending in a plane not normal to the applied stress by virtue of the rope construction, have a strength capability which is a function of the angular displacement of the yarns from the applied stress, equal to the cosine of the angle of displacement. Thus, the fact that a twist or braid is present means that those fibers are in an orientation other than longitudinal with respect to the tension loads and the strength capability is reduced. If the yarns are at an angle of 30° to the lay of the rope, they cannot develop more than 86.6% of their inherent tensile strength properties since the cosine of 30° is 0.866.

Another disadvantage arising from the angular displacement of the yarns of conventional twisted or plaited cordage is in the resultant reduction of resistance to failure by abrasion. Inasmuch as the fibers extend in an orientation not normal to the lay of the cordage, they tend to snag or catch on small projections extending from the surface of the materials served by the rope and are thus broken by abrasive means. As the rope thus wears, its strength is reduced by the loss of working fibers.

Also a disadvantage of twisted or plaited rope is the fact that once cut, the strands tend to unravel quickly. To avoid this unravelling, the plaited or twisted rope is back-spliced or bound, or in the case of rope made of plastic fiber yarns, the rope is cut with a hot knife which simultaneously severs the strands and melt fuses them to adjacent strands to prevent unravelling.

Woven webbing is also known in the art, and generally includes longitudinally extending warp strands and transversely extending weft strands, the latter being loosely woven to keep the warp strands in flat alignment forming a narrow fabric. Even where the woven webbing is hollow, the weft strand is under a small tension and is loosely woven with the warp strands.

Webbing may be made on a shuttle or circular loom or on a needle loom. In weaving, the warp strands are uniformly positioned within closely spaced dents, with the shuttle or needle reciprocating from side to side forming the weft. The reeds move axially as the heddles of the harness are selectively controlled in the usual way. For each pick, or stroke of the shuttle or needle, there is one movement of the read and either an up or down movement of the bobbin when a bobbin lock stitch needle loom is used. In this way the multiplicity of strands are held in the proper orientation and the strands coming off the needle and bobbin or shuttle merely traverse the warp threads in a loose manner since the weft strand is not under tension, the objective being to provide an essentially flat web.

Flat webbing has considerable strength but does not handle or function as does rope. For example, webbing may not be used on pulleys which generally require round cordage of considerable strength. Moreover, flat webbing has different handling characteristics than rope, for example, in the formation of knots, and is not nor can it be used as cordage.

In the manufacture of braided or twisted rope, it is usually the practice to rewind the yarn packs on thimbles or bobbins prior to formation of the twisted or braided product. In the case of braid, continuous lengths of braided rope are about 300 yards, the procedure being to splice lengths if a longer length is needed. In the case of twisted rope, the usual length is about 500 yards. Splicing is time consuming and thus expensive.

Typical prior patents are U.S. Pat. Nos. 848,189 of Mar. 26, 1907; 1,347,254 of July 20, 1920; 2,864,409 of Dec. 16, 1958; 3,035,476 of May 22, 1962; and 3,045,711 of July 24, 1962.

SUMMARY OF THE INVENTION

Cordage and rope in accordance with this invention is woven to provide a substantially round woven product in which the load bearing strands are disposed longitudinally. The ratio of cross-sectional thickness to width is from 0.75 to 1.0 thus providing a woven product that handles and feels like rope but exhibits considerably more strength and improved abrasion resistance. By using a weave in which the warp strands are longitudinally disposed and a weft strand which is in tension to draw the warp strands radially inwardly, a generally round orientation of the woven strands is woven. Since weaving does not result in twisting or plaiting of the yarns, the latter are longitudinally oriented in the load direction in line with the lay of the rope and are not subject to the same strength and abrasion resistance loss to which plaited or twisted yarns are subject. The result in a product resembling and handling like rope, in the sense that it is generally round, essentially solid in feel, but which has greater strength and abrasion resistance than a plaited or twisted product made of the same material of the same weight and diameter.

For example, woven nylon rope of the present invention of 5/16 inch diameter has a weight of 0.056 lbs. per yard, a tensile strength of 3400 pounds and provides 17.9 yards of rope per pound of material. Braided nylon rope of 5/16 inch diameter of the type described in U.S. Pat. Nos. 3,035,476 and 3,078,755, in contrast has a weight of 0.078 lbs. per yard, a tensile of 3400 pounds and provides 12.8 yards of rope per pound of material, while 5/16 diameter twisted conventional nylon rope has a weight of 0.075 pounds per yard, a tensile of 2550 pounds and provides 13.3 yards of rope per pound.

The above data demonstrates several interesting facts regarding the woven rope of this invention e.g, better strength per unit weight while being less expensive than braided or plaited rope. The manufacturing cost in terms of cost of materials is less while labor costs are less than braided rope but are believed to be equal to twisted rope. In the case of nylon woven rope, knotability is as good as plaited or twisted rope.

The woven cordage of the present invention is made on narrow fabric looms. For example, one weaver can operate 10 to 15 double head looms (Sitam Model BLE-3) producing 1300 to 1950 yards of ⅜ inch diameter woven cordage per man hour. Continuous lengths of woven cordage may be produced without a break in the warp yarn of about 8600 yards using, for example, 10080 denier yarn nylon from standard 22 pound packs. Moreover, the yarn packs need not be rewound as the yarn packs may be mounted on loom creels directly.

The woven cordage of this invention may be made on various types of looms, however, for purposes of explanation, reference will be made to a needle loom. In practicing this invention, the dent space in the reed is larger than usual with more strands per dent and a smaller number of dents than would be used in weaving narrow fabric webbing. Further, the weft strand is under tension to pull the warp strands radially inwardly thereby forming a generally round cordage with the appearance of round rope.

The product of this invention exhibits better abrasion properties than braided or twisted rope since the fibers, in accordance with this invention, run parallel to the lay of the cordage and are not subject to snagging. Woven cordage need not be spliced and can be easily and inexpensively joined by sewing, a process which cannot be used with conventional cordage.

The product of this invention exhibits better characteristics when used with the ends unspliced, unbound, or in the case of plastic cordage, untreated by hot knife or burning means, as often occurs. The woven cordage fibers of this invention, on the other hand, held in position by weft fibers under tension do not tend to unravel and can be used over an extended period of time untreated.

In another form of the invention expecially adaptable for use with strand material which shrinks, such as nylon strand material, the cordage is formed by slightly loosely weaving, for example, a generally oval shaped assemblage of strands including longitudinally warp strands and a weft strand which is not under sufficient tension to pull the warp strands radially inwardly. Thereafter, the slightly loosely woven product is treated to effect shrinking of the slightly woven product resulting in the formation of essentially round woven cordage having the appearance and feel of round rope. In effect, the shrinking process places the weft strand in tension to draw the assemblage into a round configuration.

Shrinking may be accomplished by treatment of the slightly loosely woven product in boiling water bath and drying to produce shrinkage. Optionally, a water soluble polymer material may be used in the bath to impregnate and coate the strands to form an abrasion resistant coating.

Accordingly, the several features of the invention are the provision of a woven rope product which is generally round and which has the handle and feel of twisted or plaited rope but which is stronger and has better abrasion resistance than the latter, to mention two of its advantages. Unlike webbing the weft strand is under tension to position the warp strands in a generally circular orientation by urging them radially inwardly. The presence of a weft strand also inhibits the fraying which is characteristic of braided or twisted nylon rope, and is readily spliced by sewing.

The above and other advantages will become apparent to those skilled in the art by reference to the following description taken in connection with the accompanying illustrative drawings.

DETAILED DESCRIPTION OF THE INVENTION

Figure 1:
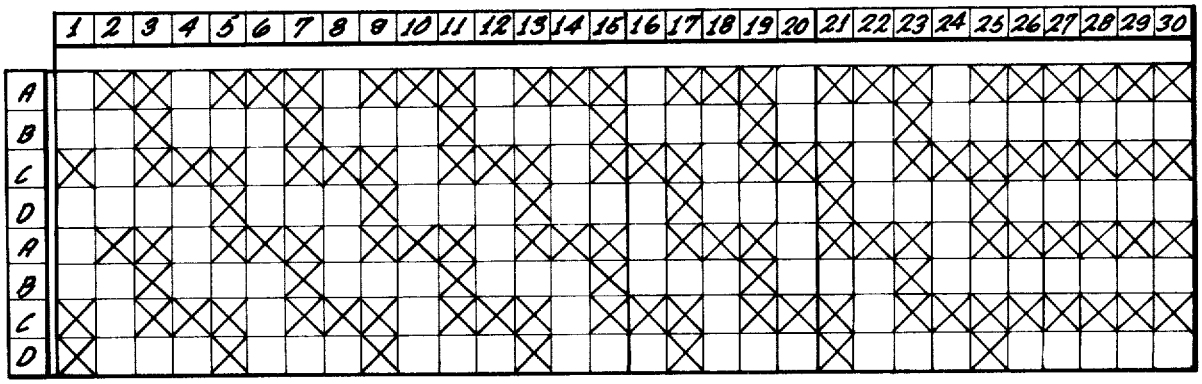
FIG. 1 is a shedding diagram of a typical weave in accordance with the present invention.

Referring to the drawings which illustrate preferred forms of the present invention, FIG. 1 shows a shedding diagram for the woven product in accordance with the present invention. It is to be understood that other patterns may be used and the one shown is for purposes of illustration.

While various types of looms may be used, a preferred loom in accordance with the present invention is a needle loom since it is inexpensive and relatively easy to operate. By way of illustration, the plain packs may be mounted on a creel and without having to rewind the yarn on thimble bobbins or reels. Yarn such as nylon of 10080 denier may be used, although the present invention is not limited to nylon or that particular denier. Various denier yarns may be used e.g. 1640 or multiples thereof such as 5040, 3280, etc. The yarn is made up of individual fibers, with the fibers being assembled to the desired denier. The yarn is fed off the loom creel to the heddles of the loom supported in the usual way in the harness so as to move in the selected pattern, a typical such pattern to be described. In the loom setup to be described, six harnesses are used which are selectively moved up and down so as to place selected yarns above and below the needle which reciprocates across the yarns.

As shown in FIG. 1, there are approximately thirty warp strands, each numbered and the same numbers will be used throughout this explanation. In the illustrative weave pattern, there are four picks which repeat. The designation *x* in the shedding diagram indicates those warp yarns which are "down". It should be noted that yarns 26 to 30 are not woven or braided or twisted but are longitudinally extending unwoven warp yarn which forms a core, as will be described.

Figure 2:
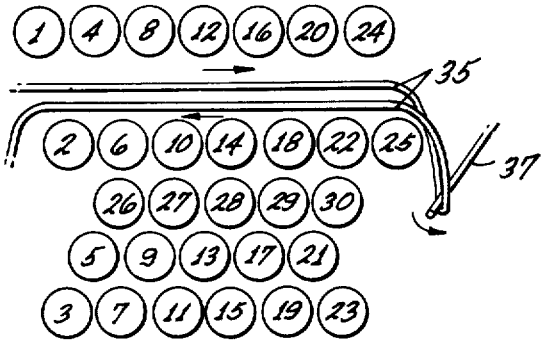
FIG. 2 is a view partly in section and partly in elevation showing the relative position of the strands during the first pick of a weaving process.

Referring to FIGS. 1 and 2, in the first pick, A, all yarns except 1, 4, 8, 12, 16, 20, and 24 are down relative to a needle yarn 35. The needle yarn 35 traverses across between the warp yarns which are up and those which are down, as illustrated. As the needle comes across the yarn, the bobbin reciprocates to loop with the needle yarn, the bobbin yarn being shown at 37. The needle yarn forms a weft strand with strands 1–25 forming warp strands and strands 26–30 forming core strands. FIG. 2 also shows the strand arrangement with respect to the harness orientation, e.g. each group of strands is supported by at least one harness in the orientation shown, for example, yarns 2, 6, 10, 14, 18, and 22 are common to the same harness.

Figure 3:
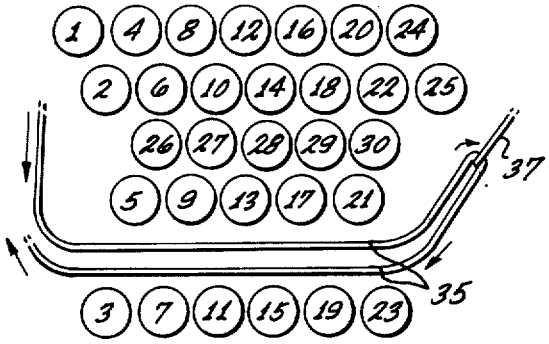
FIG. 3 is a view similar to FIG. 2 but illustrating the second pick.

In the second pick, B, illustrated in FIGS. 1 and 3, only warp yarns 3, 7, 11, 15, 19 and 23 are down, the remainder being up. Again, the needle traverses, the bobbin reciprocates and the needle returns thus carrying the weft thread 35 across and looping with the bobbin yarn 37, as shown.

Subsequent to the first and each succeeding pick, the reed moves axially relative to the direction of yarn travel to compress the weave. In the practice of this invention, the space of the dents of the reed are larger than used for webbing, for example, and there are more strands per dent with a fewer number of dents than normally used for webbing.

As can be seen from FIGS. 2 and 3, the weft strand traverses the warps and moves progressively along the length of the woven cordage.

Figure 4:
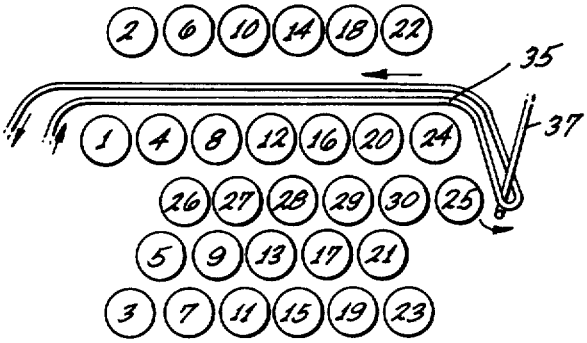
FIG. 4 is a view similar to FIG. 2 but illustrating the third pick.

In the third pick, C, shown in FIGS. 1 and 4, all strands except 2, 6, 10, 14, 18, and 22 are down. Also, strands 1, 4, 8, 12, 16, 20, and 24 which were up in pick one have changed position with strands 2, 6, 10, 14, 18, and 22, which are up in the third pick, the cross over placing the respective sets of strands on the side of the weft strand opposite from that where they were previously located. Thus, the odd numbered picks result in alternating the position of the identified sets of strands as indicated.

Figure 5:
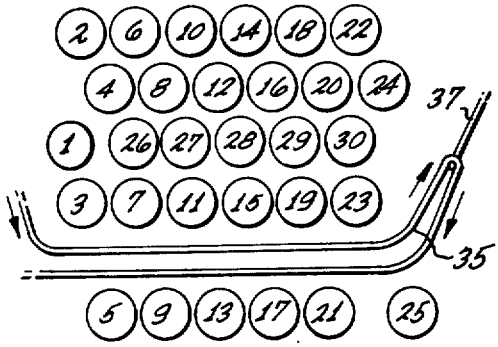
FIG. 5 is a view similar to FIG. 2 but illustrating the fourth pick.

In the fourth pick, D, shown in FIGS. 1 and 5, strands 5, 9, 13, 17, 21, and 25 are down and the remainder are up. In comparison to pick 2, FIG. 3, strands 3, 7, 11, 15, 19, and 23 have moved from below the weft strand 35 in pick two to above the weft strand in pick four. Note also that strands 1 and 25 have likewise moved, and thus these strands also function as selvedge strands. It should also be noted that whether up or down, strands 26–30 always have the same relative position i.e. they remain the center of the five sets of strands. While the two sets of strands above and below may exchange position relative to the weft strand on alternate picks, strands 26–30 always remain unwoven and untwisted in one form of the invention. In the case of cordage of 5/16 inch diameter and above, these strands function as core strands to give the cordage a solid feel. This also simplifies the weave pattern, it being understood that the core strands may be omitted or woven, if desired.

FIGS. 2 to 5 also show the weft strand 35 as a continuous single strand looped around the bobbin strand 37 for each pick.

Figure 6:
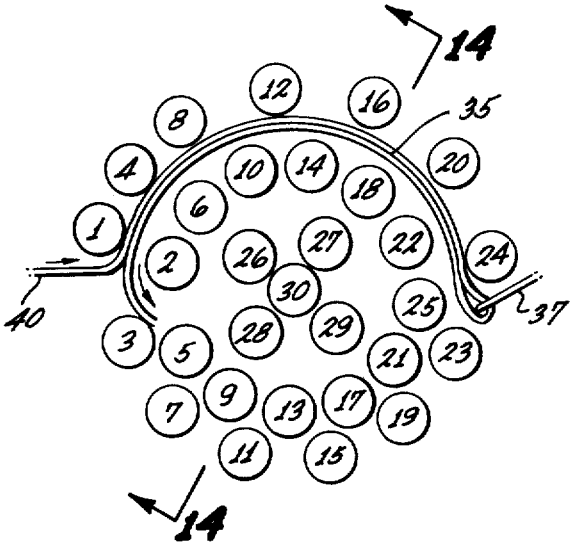
FIG. 6 is a view partly in elevation and partly in section similar to FIG. 2 and illustrating the strands of the first pick being drawn radially inwardly.
Figure 7:
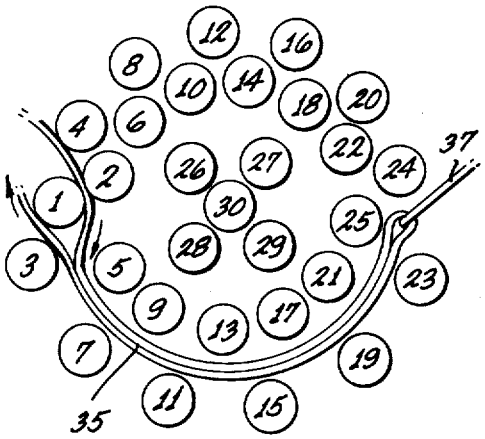
FIG. 7 is a view similar to FIG. 6 and illustrating the strands of the second pick.
Figure 8:
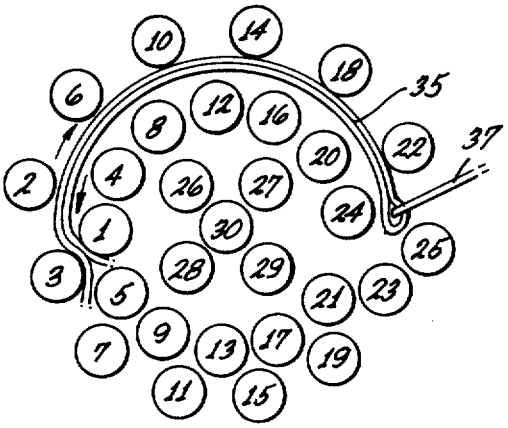
FIG. 8 is a view similar to FIG. 6 and illustrating the strands of the third pick.
Figure 9:
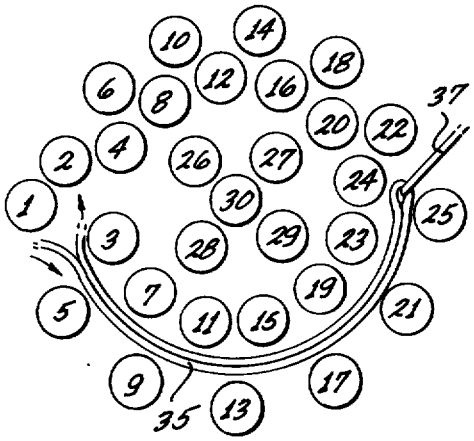
FIG. 9 is a view similar to FIG. 6 and illustrating the strands of the fourth pick.

FIG. 6 illustrates the general circular orientation of the warp strands radially inwardly toward the center which is approximately where strand 30 is located. The effect of tension on the weft strand may be easily seen by comparing sets of Figures i.e., FIGS. 6-2; 7-3; 8-4; and 9-5. Since in the odd numbered picks the sets of strands stradling the weft strand are switched, as is the case with the even numbered picks, tension on the weft strand, which traverses the groups of strands progressively along the length of the woven mass, is operative to bring the strands into orientation to produce a round product as shown in FIGS. 6–9. If no tension were applied to the weft strand, an essentially flat product would result, e.g. similar to what is shown in FIGS. 2–5. By tensioning the weft strand, a product is produced having a ratio of cross-sectional thickness to width of 0.75 to 1.0 resulting in a generally round product, which is woven, feels like rope, handles like rope, knots like rope, but possesses remarkable strength and other properties compared to twisted and braided rope made of the same strands. Since the woven rope of this invention includes substantially all warp fibers extending in a longitudinal orientation in line with the lay of the rope, the strength of the group of yarns forming the rope is substantially equal to the sum of the strengths of each of the warp yarns, without reduction from angular disposition of the yarns as is the case of conventional cordage.

Figure 10:
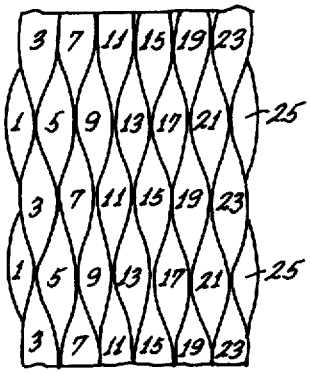
FIG. 10 is a view in perspective of the outer front surface of the rope of the present invention as seen from bottom of FIG. 6.
Figure 12:
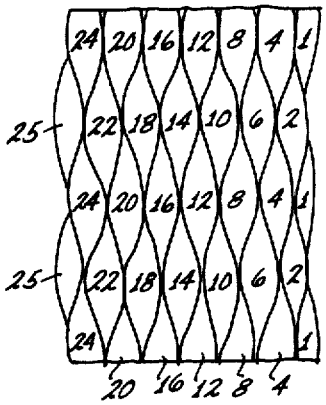
FIG. 12 is a view similar to FIG. 10 of the back of the rope as seen from above FIG. 6.
Figure 11:
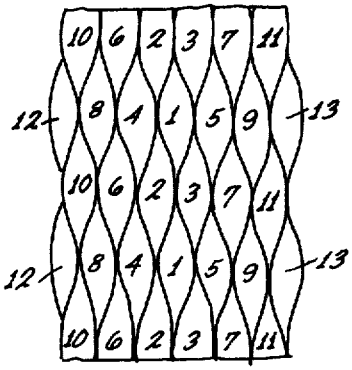
FIG. 11 is a view in perspective of the side rope in accordance with this invention as seen from the left of FIG. 6, the view being of approximately 180° of the outer side surface.
Figure 13:
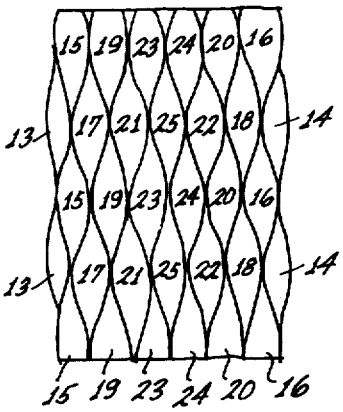
FIG. 13 is a view similar to FIG. 11 as seen from the right of FIG. 6.

Referring to FIGS. 10 to 13, the longitudinal orientation of the strands may be seen, as contrasted to a twisted or braided rope. For example, in FIG. 10, which is a view of the front of the rope (as seen from the underside of FIG. 6), the only displacement of strands 3, 7, 11, 15, 19, and 23 is that which takes place as that group of strands alternates above and below the weft strand, see FIGS. 7 and 9. Similarly the only displacement of strands 1, 5, 9, 13, 17, 21, and 25 is that which takes place as that group alternates above and below the weft strand, see FIGS. 7 and 9. A comparison of FIGS. 11, 12, and 13 shows a comparable situation, FIG. 10 showing the front of the rope, formed by picks 2 and 4 while FIG. 12 shows the back illustrating the strands woven on picks 1 and 3. The side views 11 and 13 also demonstrate the same.

In contrast, braided or twisted rope includes strands that start on the front and spiral over other strands along the side, to the bottom, up the other side and back to the top.

Figure 14:
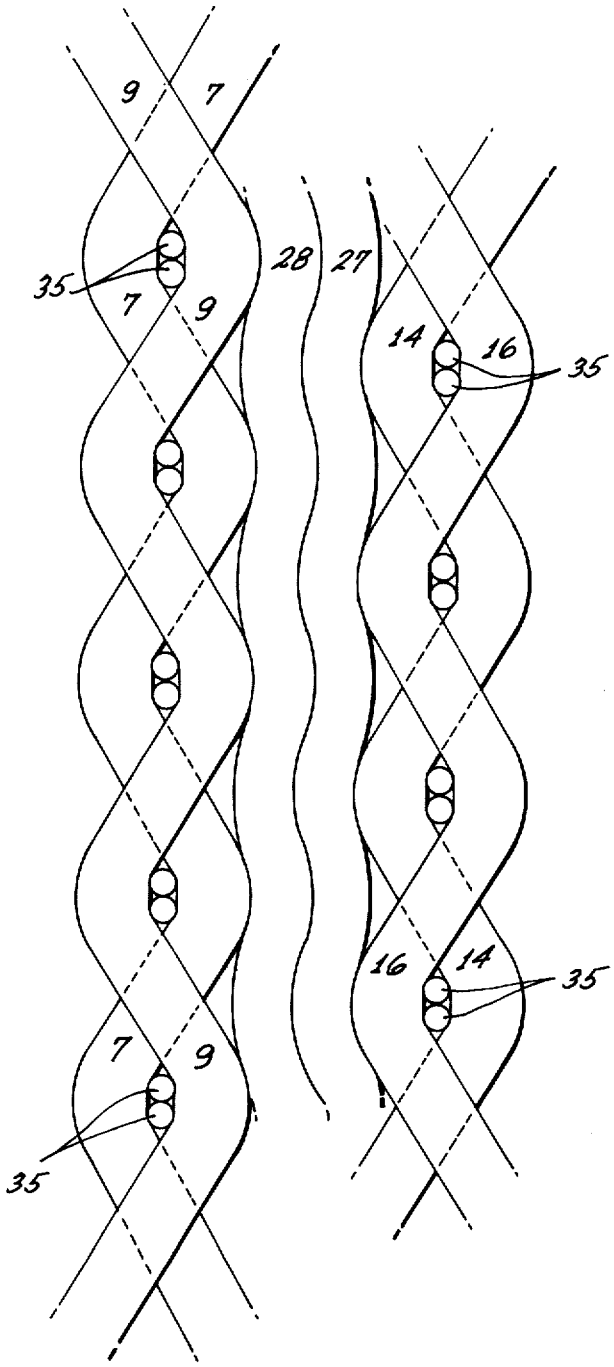
FIG. 14 is a view partly in section and partly in elevation taken generally along the line 14—14 of FIG. 13.

This strength of longitudinally extending warp strands woven with a weft strand to form a generally round rope offers substantial strength improvement. As shown in FIG. 14, in which the pattern of strands 7, 9, and 14, 16 is shown, it is apparent that there is only slight angular displacement of the warp yarns as such yarns move radially during their assembly, and not sufficiently to cause substantial strength loss in any warp yarn. Essentially the same relation exists with respect to the other strands, as is apparent from FIGS. 10–13.

Figure 15:
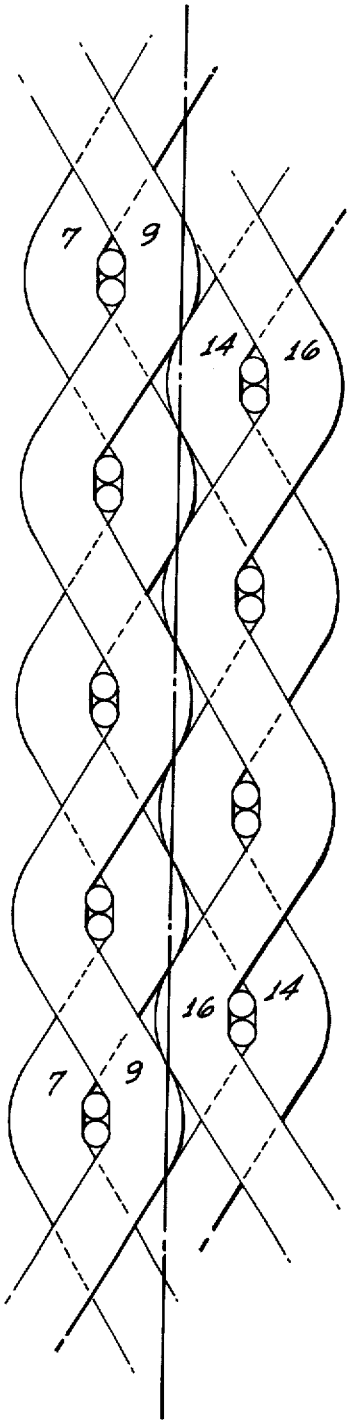
FIG. 15 is a view partly in section and partly in elevation showing a modified form of rope in accordance with the present invention.

FIG. 15, illustrates a rope in accordance with the present invention without core members. For rope of small diameter, the core can be eliminated as unnecessary since the strands contact each other and have the feel of solid rope.

Another form of the invention relates to a two part woven cordage as illustrated in FIGS. 1–15 except that there is a core portion made of a previously woven rope of such a diameter as to fit inside the woven rope, in the same manner that U.S. Pat. Nos. 3,035,476 and 3,078,755 illustrate plaited rope having an internal portion consisting of a preplaited rope portion.

One such form of prewoven rope is shown at 27 and 28 of FIG. 14 in place of the more usually used unwoven core portions.

The advantage of such prewoven core portions is that each warp yarn, including the core warp yarns, are similarly displaced by weft yarns in weaving, and when tensile forces are applied, the load is spread more evenly over each warp yarn, including the core woven warp yarns.

From FIGS. 10 to 13 it will be seen that the weft strand is not visible nor does it extend to the outer surface of the rope as defined by the outer exposed surface of the warp strands. In a sense, the weft strand is buried beneath the outer surface of the strands and thus protected from being snagged. Even if snagged and broken, however, this does not result in unravelling of the rope of the present invention.

By way of example, and referring to FIG. 6 as representing the end, if the free end 40 of the weft strand is pulled, some minor unravelling takes place, but continued pulling tightens the weft strand around the warp strands. Once tightened, certain of the warp strands which cross over the weft strand operate to prevent further unravelling. This has advantages when compared to braided or twisted rope. This type of rope, if not fused or bound will continue to unravel. The rope of the present invention will not continue to unravel, even if the buried weft strand is accidentally severed.

The longitudinal lay of the strands also improves the abrasion resistance of the woven cordage of the present invention as compared to conventional cordage. In the latter, the fact that the strands are in an orientation at an angle with the lay of the rope results in excessive abrasive wear as the rope is pulled over rough surfaces. When the fibers are at an angle to the abrading surface they are caught and broken much more easily than they would be if there were no angular displacement of fibers with respect to the direction of pull. To improve abrasion further, the woven product of this invention may be coated with a resin material, by dipping or other application.

Since the product of this invention is essentially round, it may be used with pulleys and the like, it may be knotted the same as conventional rope. Its tensile strength, however, is substantially improved over rope of the same strand composition but formed by twisting or braiding. This offers the advantage of formation of the rope of the present invention into cargo restraining netting used in cargo handling especially for transport by aircraft. The ability to form long lengths of cordage, e.g. 8600 yards permits the use of unspliced tow ropes of considerable length and substantial tensile strength. While cordage is described using 25 warp yarn and 5 core yarns, more or less strands may be used depending on the diameter of the product and the strength needed. For example, a 5/16 inch diameter woven rope may be formed of 11 strands of 5040 denier, 18 strands of 10080 denier and a needle and bobbin strands of 1680 denier. Rather than a six pick repeat pattern, an eight pick repeat pattern may be used, or other pick repeat pattern depending upon the pattern of the weave. Rather than a needle loom a shuttle loom may be used, or other form of loom, the needle loom being illustrated because it is believed faster, and is known to be capable of producing an acceptable product.

Another manner in which woven cordage of the present invention may be produced, in the case of shrinkable strands such as nylon, is by weaving an assemblage of strands in a pattern, as for example that already described, in which there is some tension on the weft strand, but not enough to bring the warp strands into a circular orientation. Thus, the assemblage of strands is a slightly loose weave and, in the pattern described, oval in shape. The slightly loosely woven assemblage of strands is then treated in a shrinking bath, e.g. boiling water, such that upon drying, the woven strands shrink into a generally round product. Core strands may be used to provide a solid core. As shrinkage takes place, which in the case of nylon is about 10%, the natural shrinkage forces produce a generally round rope having the qualities and structure as described.

In this form of producing cordage of the present invention, a water soluble polymer material may be dissolved in the hot water bath for the purpose of improving the abrasion resistance. The polymer material impregnates the assemblage and coats the outer surface of the outer strands to form an abrasion resistance coating. A preferred polymer is one which achieves water insolubility upon drying and which is resistant to organic materials. Typical such materials are polymers rendered soluble by a fugative agent which evaporates during dredging to leave a water insoluble polymer residue. Typical such film forming materials are crotonic acid-vinyl acetate copolymers and acrylic materials solubilized by ammonia, e.g. a thermo plastic film form available commercially from B. F. Goodrich Co. under the name of "Carboset". In effect, this form of the invention provides a pre-shrunk rope, a definite advantage.

While preferred forms of the present invention have been disclosed, it is apparent that other weave patterns may be used and this invention is not limited to the pattern described. The strands making up the woven cordage of this invention may be of the same or different denier. The core strands, if used may be of the same or different denier and may be the same or different in denier from those making up the warp strands. It is also possible to use selvedge strands, i.e. those along the sides which are of a greater or lesser denier than those strands making up the remainder of the cordage. Color coded cordage is also relatively easy to produce by this invention.

It will be apparent to those skilled in the art that modification may be made to the inventions herein described without departing from the scope of the invention as set forth in the appended claims.

I claim:

1. Woven rope comprising a multiplicity of warp strands extending in a longitudinal orientation and at least one weft strand interwoven with said warp strands to form a generally circular woven rope;

said weft strand being inwardly of the outer surface of outer warp strands;

said weft strand extending continuously and progressively along the length of said warp strands; and said weft strand being under tension to pull said warp strands radially inwardly into a generally circular orientation.

2. Woven rope as set forth in claim 1 wherein said weft strand is a continuous weft strand.

3. Woven rope as set forth in claim 1 wherein said rope has a cross-sectional ratio of thickness to width of at least 0.75.

4. Woven rope as set forth in claim 1 wherein said rope includes a core composed of a plurality of strands.

5. Woven rope as set forth in claim 1 wherein said rope is pre-shrunk.

6. Woven rope as set forth in claim 1 wherein the outer surface of the rope includes an abrasion resistant coating of a water insoluble polymer.

7. A woven cordage comprising a multiplicity of longitudinally extending warp strands, means forming a weft strand interwoven with predetermined selective warp strands, said weft strand extending generally transversely progressively and along the length of said woven cordage, said weft strand being radially inwardly of the outer surface of the exposed warp strands, and said weft strand being under sufficient tension to maintain said warp strands in a generally circular orientation whereby the warp strands are pulled radially inwardly towards the center of the woven mass of strands to form woven cordage having the appearance of round rope.

8. A woven cordage as set forth in claim 7 wherein said strands are composed of nylon filaments.

9. A woven rope as set forth in claim 5 wherein said circularly oriented woven warp strands surround a core composed of a plurality of strands.

10. A woven cordage as set forth in claim 8 wherein said cordage is pre-shrunk.

11. A woven cordage as set forth in claim 8 wherein the outer surface of said cordage includes an abrasion resistant coating of a water insoluble polymer.

12. A woven rope as set forth in claim 9 wherein said core is a plurality of unwoven substantially longitudinally oriented strands.

13. A woven rope as set forth in claim 9 wherein said core is a prewoven core composed of substantially longitudinally oriented strands.

14. A woven cordage as set forth in claim 7 wherein said strands are composed of strands having a different denier.

15. A woven cordage as set forth in claim 7 wherein said means forming a weft strand is comprised of a needle thread interlooped to form a weft strand which is under tension to pull said warp strands into circular orientation.

16. A woven cordage as set forth in claim 7 wherein the ratio of the cross-sectional thickness to width of said cordage is at least 0.75.

17. A generally circular woven rope characterized by a predetermined strength in tension which is greater than an equal weight per yard of the same material formed into rope by braiding or twisting and comprising:

a multiplicity of longitudinally extending warp strands, means forming a weft strand interwoven with said warp strands and being radially inwardly of the outer surface of the exposed warp strands, said warp strands being oriented in a generally circular orientation, and said weft strand being in tension to urge said warp strands radially inwardly towards the center of said woven mass of strands to form a woven rope of generally circular cross-section.

18. A generally circular woven rope as set forth in claim 17 wherein said weft strand is operative upon cutting said rope to secure together the free cut ends of said longitudinally extending strands.

19. A generally circular rope as set forth in claim 17 wherein the rope includes a core of unwoven, untwisted, and unbraided longitudinally extending center strands.

20. A generally circular rope as set forth in claim 17 wherein the rope includes a prewoven core composed of substantially longitudinally extending strands.

21. Woven rope comprising a plurality of longitudinally extending warp strands, means forming a weft strand woven into said warp strands to form a woven assemblage of strands, said weft strand being radially inwardly of the outer exposed surface of the exposed warp strands, said warp strands including selvedge strands oriented in a longitudinal direction along the sides of said rope;

said weft strand being in tension to pull said warp strands radially inwardly into a generally circular orientation; and said woven assemblage of strands having a cross-sectional ratio of thickness to width of at least 0.75.

22. Woven rope as set forth in claim 21 wherein said warp strands surround a plurality of unwoven center strands.

23. Woven rope as set forth in claim 21 wherein said strands are nylon strands.

24. A method of forming round rope comprising weaving a plurality of warp strands and at least one weft strand into an assemblage of generally longitudinally extending warp strands, applying tension to said weft strand during weaving to urge said warp strands radially inwardly to form generally round rope.

25. A method as set forth in claim 24 wherein said weaving is conducted on a needle loom.

26. A method as set forth in claim 24 wherein preselected warp strands forming the outer surface of said rope alternately cross said weft strand.

27. A method of forming round rope comprising weaving a plurality of warp strands and at least one weft strand into a predetermined pattern in which preselected warp strands forming the outer surface of said rope alternately cross said weft strand, applying tension to said weft strand during said weaving, and shrinking said woven plurality of strands to increase the tension of the weft to draw said warp strands into a generally circular orientation to form said round rope, 28. A method of forming round rope as set forth in claim 27 wherein said shrinking step includes immersing said woven rope into a heated water bath.

29. A method of forming round rope as set forth in claim 28 wherein said bath includes a water soluble polymer material therein for forming a water insoluble polymeric abrasion resistant coating on the outer surface of said rope upon drying of said rope.

* * * * *